US006976825B2

(12) United States Patent
Wikner

(10) Patent No.: US 6,976,825 B2
(45) Date of Patent: Dec. 20, 2005

(54) INTEGRATED ASPIRATOR AND FAN SHROUD

(75) Inventor: Aaron David Wikner, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/675,619

(22) Filed: Sep. 30, 2003

(65) Prior Publication Data

US 2005/0069412 A1 Mar. 31, 2005

(51) Int. Cl.[7] ..... F04D 29/54
(52) U.S. Cl. ..... 415/211.1; 415/223
(58) Field of Search ..... 415/208.1, 211.1, 415/223, 214.1, 185–6; 416/169 A; 55/385.3; 180/68.1; 123/41.7, 41.49

(56) References Cited

U.S. PATENT DOCUMENTS 5,427,502 A 6/1995 Hudson
6,588,524 B2 7/2003 Keen et al.

*Primary Examiner*—Edward K. Look
*Assistant Examiner*—Dwayne J. White

(57) ABSTRACT

A fan shroud having an integrated aspirator is provided comprising a first section and a second section. The first section and second section are designed to mateably engage one another so as to form an air passage between a fan and a cooling module of a vehicle. The first section of the shroud includes an air duct formed by a channel in the shroud and a similar channel in a duct cover, so that when the duct cover is mated to the first section of the shroud an air duct is created. A first end of the air duct terminates at an aperture disposed in an end of shroud situated proximal to the fan. A second end of the air duct curves upwardly to a nozzle provided on the top side of the duct cover. A pre-cleaner unit having an air intake and an air exhaust is aspirated through an aspirator port. When the pre-cleaner is mounted to the shroud, the aspirator port is disposed in the nozzle of the duct cover. The aspirator port is thus in communication with the air duct and the shroud aperture. The vacuum necessary for proper aspiration of the pre-cleaner is provided by air movement, induced by the fan, between the air intake of the pre-cleaner and the shroud aperture via the aspirator port and air duct. Because the pre-cleaner is fitted directly to the air duct, no additional aspirator hoses or clamps are necessary and considerable space is conserved under the vehicle hood.

9 Claims, 3 Drawing Sheets

INTEGRATED ASPIRATOR AND FAN SHROUD

FIELD OF THE INVENTION

The present invention relates generally to air intake systems for internal combustion engines. More particularly, the present invention relates to such systems which employ a pre-cleaner. Specifically, the present invention relates to aspirators for supplying a vacuum to such pre-cleaners.

BACKGROUND OF THE INVENTION

Engine air intake systems for work vehicles frequently include a pre-cleaner to remove dirt particles from the intake air prior to the air filter. Many pre-cleaners require a vacuum to pull or "scavenge" dirt particles from the fresh air ingested into the air intake system. Exhaust system aspirators have been used to supply the required vacuum. An exhaust system aspirator, however, creates a restriction in the engine exhaust, raises noise levels and raises the cost of the muffler and/or exhaust pipe. Also, a check valve is needed to prevent back flow of high temperature gases into the pre-cleaner and high temperature hoses must be used.

An alternative approach is to use a fan shroud aspirator as a source of vacuum to a pre-cleaner. This aspirator is typically an opening in the fan shroud enabling a hose to link with a pre-cleaner. One drawback to known fan shroud aspirators is that they typically require additional hoses and clamps. Accordingly, for cost and space savings, it is desirable to reduce the number of extraneous parts required for pre-cleaner aspiration. Modern agricultural tractors and other work vehicles sometimes require a rather long fan shroud to fill the gap between the cooling module and the fan. Thus it is desired to integrate the pre-cleaner aspirator into the fan shroud itself to reduce parts counts and costs and also to satisfy space constraints.

SUMMARY OF THE INVENTION

In view of the foregoing, it is an object of the invention to provide aspiration for a work vehicle pre-cleaner.

Another object of the invention is the provision of a fan shroud between the fan and the cooling module of a work vehicle.

A further object of the invention is to provide a fan shroud for a work vehicle which has the pre-cleaner aspirator integrated therein.

An additional object of the invention is the provision of such a fan shroud and aspirator which is compatible with known manufacturing and assembly techniques and equipment.

Still another object of the invention is the provision of such a fan shroud aspirator which utilizes a minimal number of parts and optimizes the use of space under the hood of the vehicle.

The foregoing and other objects of the invention together with the advantages thereof over the known art which will become apparent from the detailed specification which follows are attained by a fan shroud aspirator for use with a pre-cleaner having an aspirator port, the fan shroud being disposed between a fan and a cooling module, comprising: an air duct in a surface of the fan shroud, the air duct communicating between a nozzle and an aperture provided in the fan shroud proximal to the fan, the pre-cleaner being mounted to the fan shroud such that the aspirator port is in direct communication with the passage via the nozzle; whereby a vacuum necessary for proper aspiration of the pre-cleaner is provided by an air flow induced by the fan through the air duct.

In general, a fan shroud having an integrated aspirator is provided comprising a first section and a second section. The first section and second section are designed to mateably engage one another so as to form an air passage between a fan and a cooling module of a vehicle. The first section of the shroud includes an air duct formed by a channel in the shroud and a similar channel in a duct cover, so that when the duct cover is mated to the first section of the shroud an air duct is created. A first end of the air duct terminates at an aperture disposed in an end of shroud situated proximal to the fan. A second end of the air duct curves upwardly to a nozzle provided on the top side of the duct cover. A pre-cleaner unit having an air intake and an air exhaust is aspirated through an aspirator port. When the pre-cleaner is mounted to the shroud, the aspirator port is disposed in the nozzle of the duct cover. The aspirator port is thus in communication with the air duct and the shroud aperture. The vacuum necessary for proper aspiration of the pre-cleaner is provided by air movement, induced by the fan, between the air intake of the pre-cleaner and the shroud aperture via the aspirator port and air duct. Because the pre-cleaner is fitted directly to the air duct, no additional aspirator hoses or clamps are necessary and considerable space is conserved under the vehicle hood.

To acquaint persons skilled in the art most closely related to the present invention, one preferred embodiment of the invention that illustrates the best mode now contemplated for putting the invention into practice is described herein by and with reference to, the annexed drawings that form a part of the specification. The exemplary embodiment is described in detail without attempting to show all of the various forms and modifications in which the invention might be embodied. As such, the embodiment shown and described herein is illustrative, and as will become apparent to those skilled in the art, can be modified in numerous ways within the spirit and scope of the invention—the invention being measured by the appended claims and not by the details of the specification.

BRIEF DESCRIPTION OF THE DRAWINGS

For a complete understanding of the objects, techniques, and structure of the invention reference should be made to the following detailed description and accompanying drawings, wherein.

DESCRIPTION OF THE PREFERRED EMBODIMENT

Figure 1:
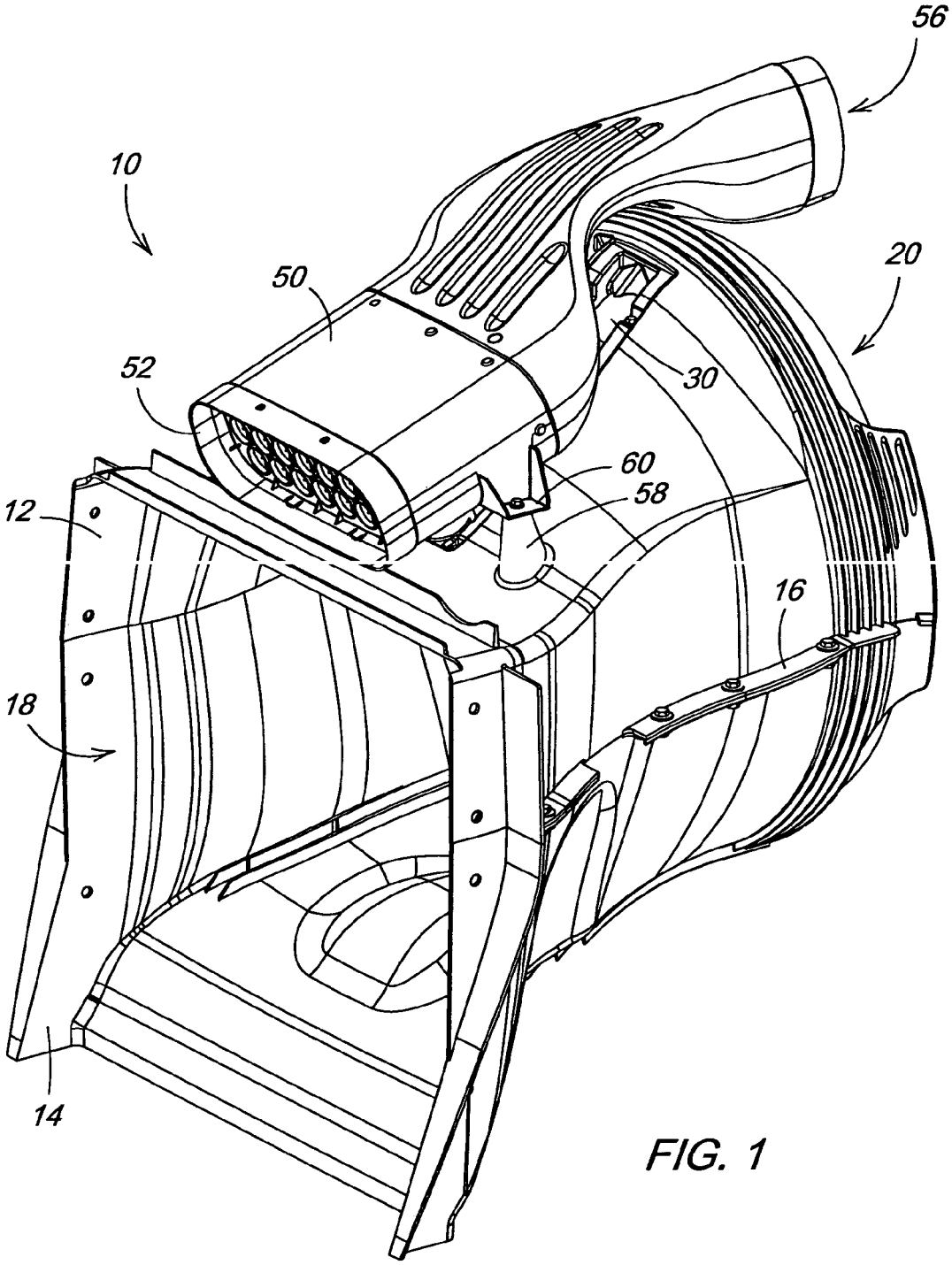
FIG. 1 is a perspective view of a fan shroud and pre-cleaner assembly according to the invention.
Figure 2:
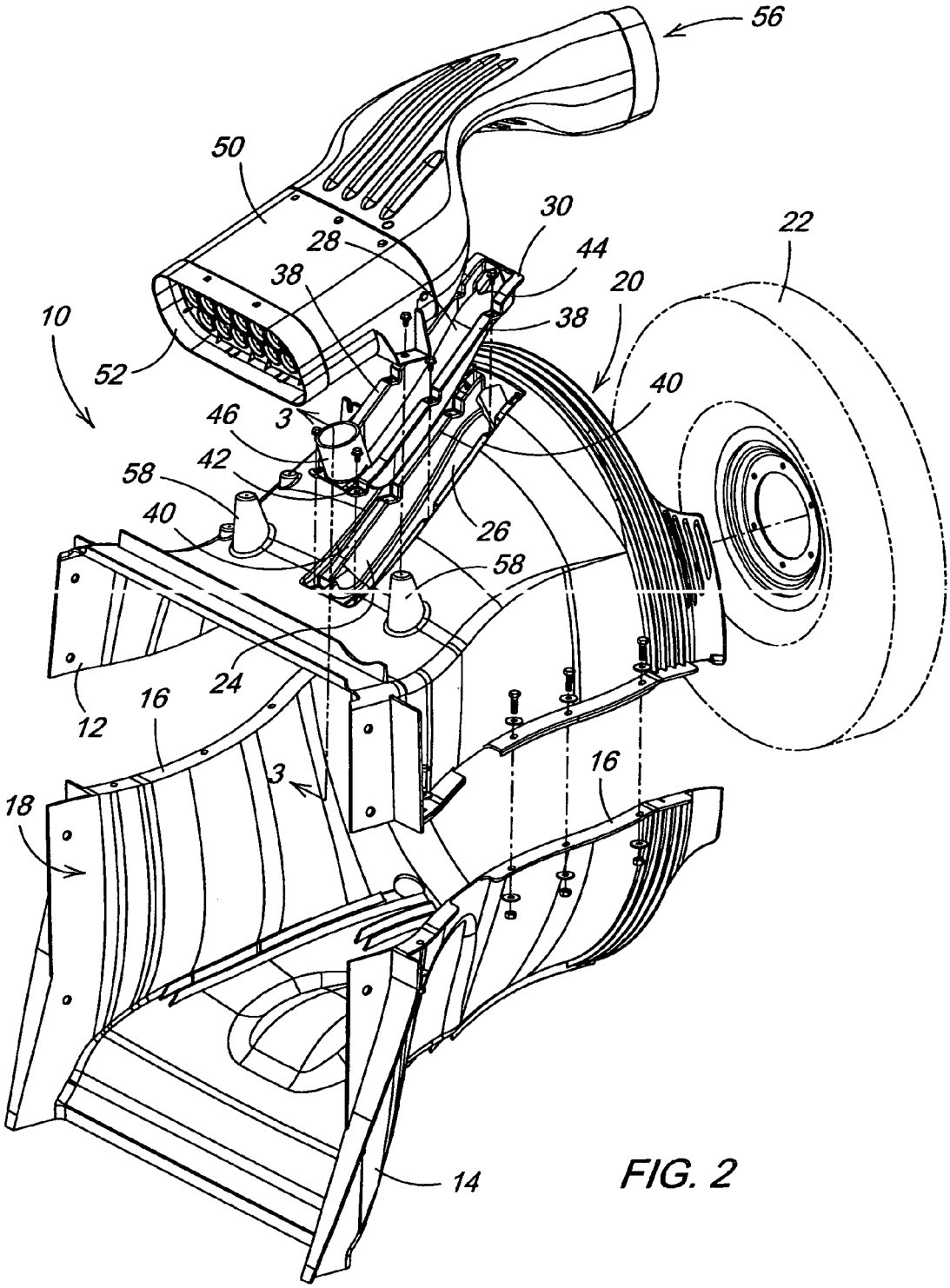
FIG. 2 is an exploded perspective view of the assembly of FIG. 1.
Figure 3:
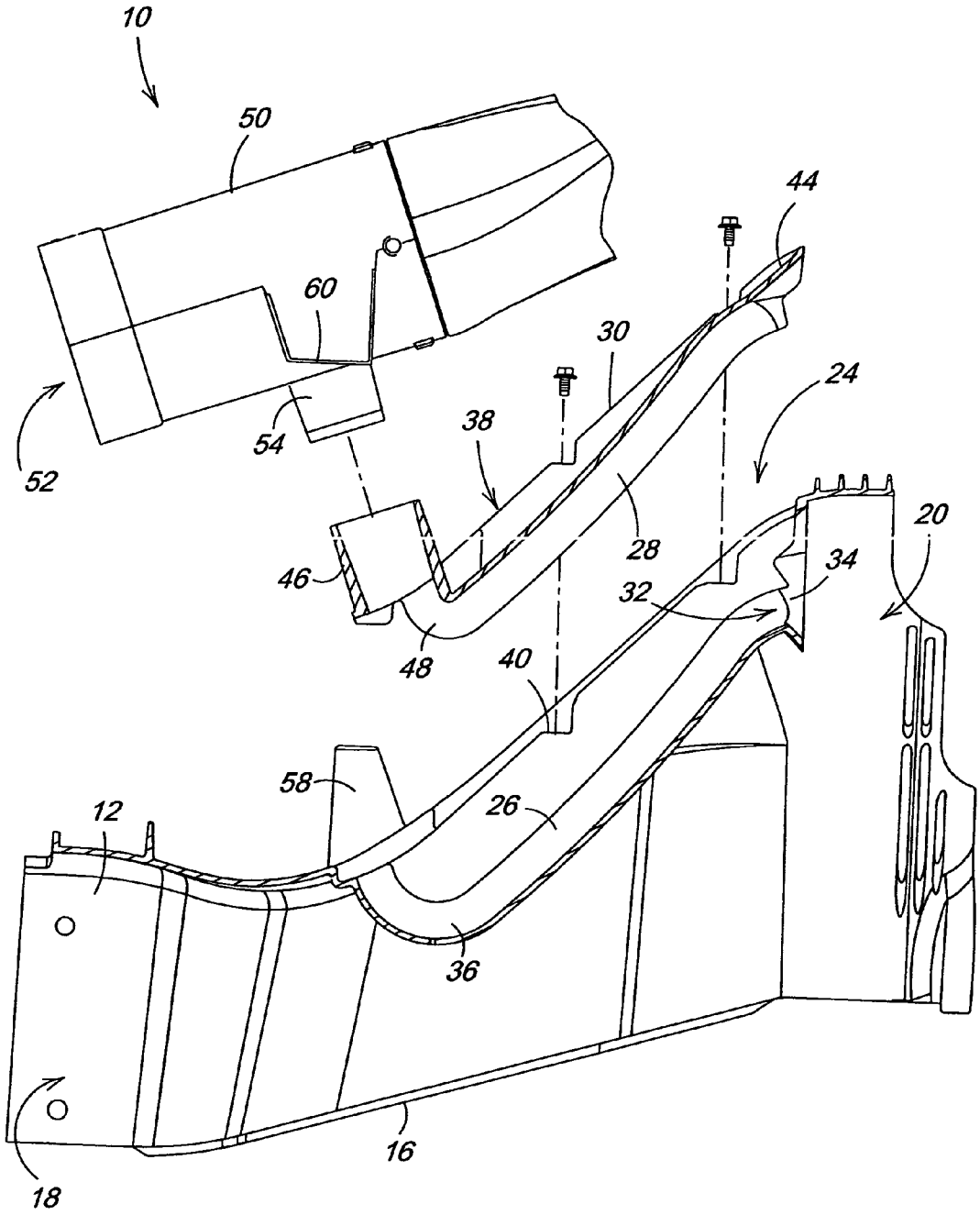
FIG. 3 is a cross-sectional view taken along the line 3—3 of FIG. 2.

With reference now to the drawings it can be seen that a fan shroud having an integrated aspirator according to the invention is designated generally by the numeral 10. As shown the fan shroud 10 is comprised of a first section 12 and a second section 14 and is preferably formed of a thermoplastic or thermoset material in an appropriate conventional molding process. The first section 12 and the second section 14 are designed to mateably engage one another at mating flanges 16 so as to form an air passage between a fan and a cooling module of the vehicle. Accordingly, a first end 18 of the shroud 10 is adapted for disposal proximal to the cooling module (not shown) while a second end 20 is adapted for disposal proximal to the fan 22. Thus air is drawn through the radiator by the fan 22. As is perhaps best illustrated in FIGS. 2 and 3 the first section 12 of the shroud 10 includes an air duct generally indicated by the numeral 24. The air duct 24 is comprised of a molded channel 26 formed in the first section 12 of the shroud 10 and by a similar channel 28 formed in a duct cover 30. The channels 26 and 28 each have a semi-circular cross section so that when the duct cover 30 is mated to the first section 12 of the shroud 10 a cross-sectionally circular passage (air duct) is formed. A first end 32 of the channel 26 terminates at an aperture 34 disposed in the second end 20 of the shroud 10. For reasons which will become apparent as the description continues the aperture 34 is situated proximal to the fan 22. A second end 36 of the channel 26 curves upwardly to a terminus roughly midway between the first end 18 and the second end 20 of the shroud 10. The duct cover 30 includes a pair of flanges 38 disposed on either side of the channel 28 for purposes of fastening the cover 30 to like mating surfaces 40 on either side of the channel 26. Fastener apertures 42 are provided in both the duct cover flanges 38 and the mating surfaces 40 for purposes of securing the cover 30 to the shroud 10 with appropriate fasteners. A first end 44 of the channel 28 terminates at an end of the duct cover 30 such that the circular aperture 34 through the shroud 10 is completed. A nozzle 46 is provided on the top side of the duct cover 30 which communicates with the second end 48 of the channel 28 at the area where the channel 26 of the first section 12 curves upwardly as previously described. Thus when the duct cover 30 is in place the air duct 24 comprises a continuous cross-sectionally circular passage between the aperture 34 proximal to the fan and the upwardly disposed nozzle 46 of the duct cover 30.

An engine intake air pre-cleaner unit 50 includes an air intake 52, an aspirator port 54 and an air exhaust 56. In use, air is drawn in through the air intake 52, dirt particles are "scavenged" from the air, and the cleaned air exits the pre-cleaner 50 at the air exhaust 56 which is connected to the engine intake (not shown). The pre-cleaner 50 is aspirated through the aspirator port 54 via a vacuum provided by the fan 22 as will be described below.

A pair of pre-cleaner mounting bosses 58 are provided on the first section 12 of the shroud 10 as shown. The mounting bosses 58 correspond to mounting tabs 60 provided on the pre-cleaner housing. Thus the pre-cleaner 50 is mounted to the shroud 10 by way of appropriate fasteners. When the mounting tabs 60 are aligned with the mounting bosses 58 the aspirator port 54 is positioned such that it is slidably disposed in the nozzle 46 of the duct cover 30. Accordingly, the aspirator port 54 is in communication with the air duct 24 and the shroud aperture 34. As should now be apparent the vacuum necessary for proper aspiration of the pre-cleaner 50 is provided by air movement, induced by the fan 22, between the air intake 52 of the pre-cleaner 50 and the shroud aperture 34 via the aspirator port 54 and the air duct 24. Because the pre-cleaner 50 is fitted directly to the air duct 24 of the shroud 10 no additional aspirator hoses or clamps are necessary and considerable space is conserved under the vehicle hood.

Thus it can be seen that the objects of the invention have been satisfied by the structure presented above. While in accordance with the patent statutes, only the best mode and preferred embodiment of the invention has been presented and described in detail, it is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A fan shroud aspirator for use with a pre-cleaner having an aspirator port, the fan shroud comprising a first section and a second section, the fan shroud being disposed between a fan and a cooling module, comprising:

an air duct in a surface of the fan shroud, the air duct communicating between a nozzle and an aperture provided in the fan shroud proximal to the fan, the pre-cleaner being mounted to the fan shroud such that the aspirator port is in direct communication with the air duct via the nozzle;

whereby a vacuum necessary for proper aspiration of the pre-cleaner is provided by an air flow induced by the fan through the air duct.

2. A fan shroud aspirator as described in claim 1 wherein the first and second sections each have mating flanges whereby the first and second sections are united to form a complete fan shroud.

3. A fan shroud aspirator as described in claim 2 wherein the first section has an air duct molded therein.

4. A fan shroud aspirator as described in claim 3 wherein the air duct comprises a first channel molded in the first section and a second channel molded in a duct cover.

5. A fan shroud aspirator as described in claim 4 wherein each channel has a cross-section such that when the duct cover is mated to the first section of the shroud, the air duct is formed therebetween.

6. A fan shroud aspirator as described in claim 5 wherein the duct cover has flanges on either side of the channel that correspond to mating surfaces on the first section of the shroud so that the duct cover can be mateably affixed to the first section of the shroud.

7. A fan shroud aspirator as described in claim 5 wherein the duct cover includes the nozzle that communicates with the air duct when the duct cover is mounted to the first section of the shroud.

8. A fan shroud aspirator as described in claim 7 wherein the first section of the shroud includes a plurality of mounting bosses for mounting the pre-cleaner to the fan shroud so that when the pre-cleaner is mounted to the mounting bosses the aspirator port of the pre-cleaner is disposed for communication with the nozzle of the duct cover.

9. A fan shroud aspirator as described in claim 8 wherein the fan shroud is molded from a thermoplastic or thermoset material.

* * * * *